US007878167B2

(12) United States Patent
Decuir, Jr.

(10) Patent No.: US 7,878,167 B2
(45) Date of Patent: Feb. 1, 2011

(54) ENGINE WITH ROUND LOBE

(76) Inventor: Julian A. Decuir, Jr., P.O. Box 720801, Pinon Hills, CA (US) 92372

( * ) Notice: Subject to any disclaimer, the term of this patent is extended or adjusted under 35 U.S.C. 154(b) by 471 days.

(21) Appl. No.: 12/080,866

(22) Filed: Apr. 7, 2008

(65) Prior Publication Data

US 2009/0050083 A1 Feb. 26, 2009

Related U.S. Application Data

(60) Provisional application No. 60/957,968, filed on Aug. 24, 2007.

(51) Int. Cl.
*F01L 1/18* (2006.01)

(52) U.S. Cl. ..... 123/90.44; 123/90.39; 123/90.6; 123/90.65; 74/569

(58) Field of Classification Search ..... 123/90.16, 123/90.39, 90.44, 90.6, 90.65; 74/559, 567, 74/569

See application file for complete search history.

(56) References Cited

U.S. PATENT DOCUMENTS 4,858,573 A 8/1989 Bothwell
6,053,134 A 4/2000 Linebarger
6,945,206 B1 9/2005 Mobley
7,082,912 B2 * 8/2006 Folino ..... 123/90.16
2008/0060596 A1 3/2008 Decuir

FOREIGN PATENT DOCUMENTS

GB 2166799 A 11/1984

* cited by examiner

*Primary Examiner*—Ching Chang
(74) *Attorney, Agent, or Firm*—Stetina Brunda Garred & Brucker

(57) ABSTRACT

An engine with intake and exhaust valves that may be controlled with a circular cam lobe is provided. The rotating axis of the circular cam lobe is offset from the physical center of the cam lobe. This permits the cam lobe to impart a reciprocal opening and closing of the valve. To maintain the valve in the closed position, the interconnection between the cam lobe and the valve 12 may have a spring which is compressed to allow the valve to remain closed for a set duration of time while the cam lobe continues to rotate.

15 Claims, 11 Drawing Sheets

FIG. 2
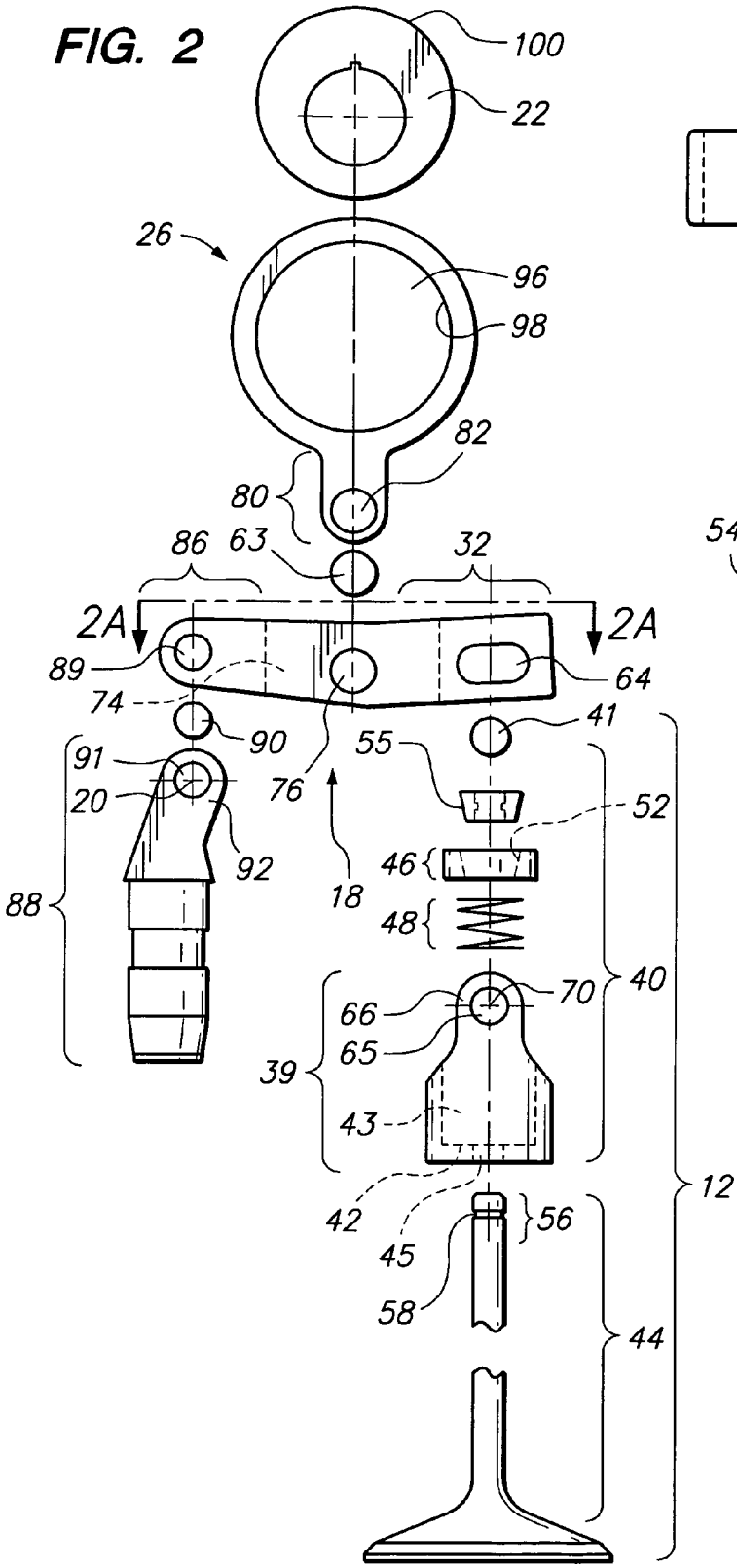
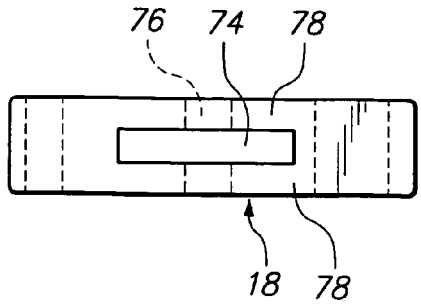
FIG. 2A
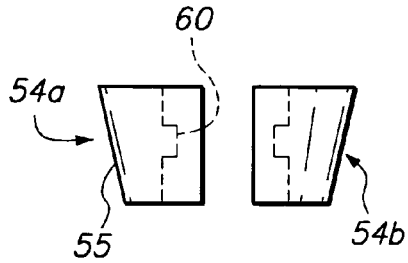
FIG. 2B

ENGINE WITH ROUND LOBE

CROSS-REFERENCE TO RELATED APPLICATIONS

This application claims priority to U.S. Prov. Pat. App. Ser. No. 60/957,968, filed Aug. 24, 2007, the entire contents of which is expressly incorporated herein by reference. This application is related to U.S. Pat. App. Ser. No. 60/843,074, filed on Sep. 8, 2006, the entire contents of which are expressly incorporated herein by reference.

STATEMENT RE: FEDERALLY SPONSORED RESEARCH/DEVELOPMENT

Not Applicable

BACKGROUND

The present invention relates to desmodromic and cam systems for internal combustion engines with intake and exhaust valves.

Most conventional internal combustion piston driven engines utilize valve trains to induct an air/fuel mixture into the cylinders and to expel the burned air/fuel mixture from the cylinders. Typically, each cylinder is assigned at least one intake valve and at least one exhaust valve. The valves are pushed down by rockers thereby opening the valve and pushed upwardly by springs thereby closing the valve. When the valve stem is pushed down by the rocker to open the valve, the spring is compressed. The valve is closed when the spring decompresses thereby pulling the valve stem up through the valve guide until the head of the valve is seated in the valve seat.

For example, in a typical four-stroke engine, an intake valve is opened by an intake rocker which receives an input force from an intake cam lobe while the piston goes down inducting an air/fuel mixture into the cylinder. This is known as the induction stroke. While the intake valve stem is being pushed down through an intake valve guide, an intake spring concentrically positioned around the intake valve stem is compressed. Next, the cam lobe continues to rotate allowing the intake spring to decompress. The intake spring pushes the intake valve back up through the intake valve guide until the intake valve is seated in the intake valve seat. The piston also moves back up the cylinder. At this point in the combustion process, the air/fuel mixture is compressed. This stage is known as the compression stroke. With both the intake and exhaust valves closed so that the combustion chamber is sealed tight, a spark is then produced by a spark plug which ignites the air/fuel mixture wherein the rapidly expanding hot gasses force the piston downward with great energy creating power. This is known as the power stroke. The exhaust valve is then opened by an exhaust rocker receiving input from an exhaust cam lobe. The piston moves up the cylinder and the exhaust valve expels the burned air/fuel mixture, also known as the exhaust stroke. The exhaust cam lobe continues to rotate and allows an exhaust spring to push the exhaust valve back to the closed position.

The aforementioned conventionally configured valve train system for opening and closing the valves have proven to be highly effective and reliable in the past. However, closing the valve by the force of the spring does have some disadvantages. For example, pushing the valve open against the force of the spring consumes engine power. The springs are strong such that the valves will close in accordance with the profile of the cam lobe and before the cam lobe pushes the rocker to reopen the valve during its next cycle. The valve springs are continuously pushing the valves closed and work must be performed to overcome such spring tension wasting energy that could be used to create output power. Another disadvantage is that because the cam mechanism cannot afford to have any "bounce" from the springs, the cam profile has to be somewhat gentle, i.e., it must gently push the valve, but never shove it. This means the valve must open slowly like a water faucet—not quickly like a light switch, for example. Another disadvantage is that when the motor is turned at high rpms, the valves can "float" and hit the piston. In other words, the spring does not traverse the valve back to the closed position fast enough such that the piston hits the valve. Valve float happens when the speed of the engine is too great for the valve spring to handle. As a result, the valves may stay open and/or "bounce" on their seats.

To overcome these disadvantages, innovative desmodromic valve trains have evolved over about the last century; however, in a very slow technological pace and in most applications with limited success. The term "desmodromic" arises from the two greek words: "desmos" (controlled or linked), and "dromos" (course or track). A desmodromic system is also known as a system that provides "positive valve actuation" wherein both strokes are "controlled." The desmodromic valves are those which are positively closed by leverage system or follower, rather than relying on the more conventional springs to close the valves.

Desmodromic valve trains have several advantages over conventional spring closed valve trains. A first major advantage is that in a desmodromic valve system, there is no wasted energy in driving the valve train. The reason is that the constant force of the springs in a conventional spring closed valve train is removed.

BRIEF SUMMARY

The desmodromic valve system discussed herein and shown in the figures address the deficiencies known in the art, discussed above and those below.

In a first embodiment of the desmodromic valve system, a circular cam lobe is provided. The circular cam lobe may be attached to a rotating cam shaft such that the rotating axis of the circular cam lobe is offset from a center of the circular cam lobe. The circular cam lobe is received into a follower. The circular cam lobe is operative to rotate and slide within the follower. As the circular cam lobe rotates about the rotating axis, the circular cam lobe imparts an up and down motion to a rocker attached to the follower. The up and down motion of the rocker closes and opens the valve. The rocker may be attached to the valve, and more particularly, to a valve stem via a valve stem keeper. The valve may be spring loaded to the valve stem keeper such that as the valve enters a closed phase, the spring of the valve stem keeper permits the cam lobe to continue rotating about its rotating axis. The spring of the valve stem keeper compresses to allow the rocker to pivot upwards while the valve head remains seated on the valve seat. As the cam lobe continues to rotate about the rotating axis, the spring begins to decompress. When the spring has fully decompressed, the rocker pivots downward and pushes the valve head off of the valve seat to open the valve.

In a second embodiment of the desmodromic valve system, the follower is spring loaded to the rocker to allow the cam lobe to continue rotating while the valve head is seated on the valve seat. In particular, as the valve enters the closed phase, the valve head is seated on the valve seat. At this moment, the valve is closed. The spring disposed between the follower and the rocker begins to compress while the rocker and the valve remain stationary. The cam lobe continues to rotate and lift the follower upward. As the cam lobe continues to rotate, the spring decompresses. When the spring is fully decompressed, the follower pushes the rocker downward and opens the valve.

In a third embodiment of the desmodromic valve system, the follower is spring loaded to the valve stem of the valve to allow the cam lobe to continue rotating while the valve head is seated on the valve seat. In particular, the valve stem keeper illustrated and discussed in the first embodiment may be employed in this third embodiment of the desmodromic valve system. During operation, the follower closes and opens the valve in a one to one correlation. As the cam lobe rotates, the valve head is seated on the valve seat. At this moment, the valve is closed. The spring disposed between the follower and the valve stem begins to compress while the valve remains stationary. The cam lobe continues to rotate and lift the follower upward. As the cam lobe continues to rotate, the spring continues to compress until the cam lobe has reached its topmost position. As the cam lobe continues to rotate, the cam lobe pushes the follower downward. The spring begins to decompress. When the spring is fully decompressed, the follower pushes the valve stem downward such that the valve head no longer contacts the valve seat. At this moment, the valve is open. The cam lobe continues to rotate such that the valve head is lowered then raised back upward until the valve head contacts the valve seat. The above cycle is repeated until the engine is turned off.

BRIEF DESCRIPTION OF THE DRAWINGS

These and other features and advantages of the various embodiments disclosed herein will be better understood with respect to the following description and drawings, in which like numbers refer to like parts throughout, and in which:

FIG. 2 is an exploded view of the engine shown in FIG. 1A;

DETAILED DESCRIPTION

FIGS. 1A-1D are side cross-sectional views of an engine 10 which does not utilize springs normally used to close a valve 12. The engine 10 incorporates a desmodromic valve and cam system 14 that may be incorporated into modern engine designs yet to be manufactured, or provided as a retrofit kit to be used on existing head designs, such as used in conventional V8's, V6's, V10's, inline 4's, inline 6's and the like. The desmodromic valve and cam system 14 may be utilized with gasoline type engines or diesel engines. More generally, the various aspects of the desmodromic valve and cam system 14 may be utilized in various engine designs which use poppet valves. It is appreciated that the desmodromic valve and cam system 14 may be installed and/or retrofitted to fit on many other conventional heads that have been previously manufactured or which are currently being manufactured from numerous engine manufacturers. Additionally, it is recognized that the desmodromic valve and cam system 14 may be integrated into specially designed heads. Thus, the scope of the desmodromic valve and cam system 14 should not be limited to the exemplary embodiment(s) disclosed herein. Rather, the exemplary embodiments of the desmodromic valve and cam system 14 disclosed herein should be viewed merely as one embodiment of numerous embodiments which may utilize the concepts disclosed herein.

Figure 1A:
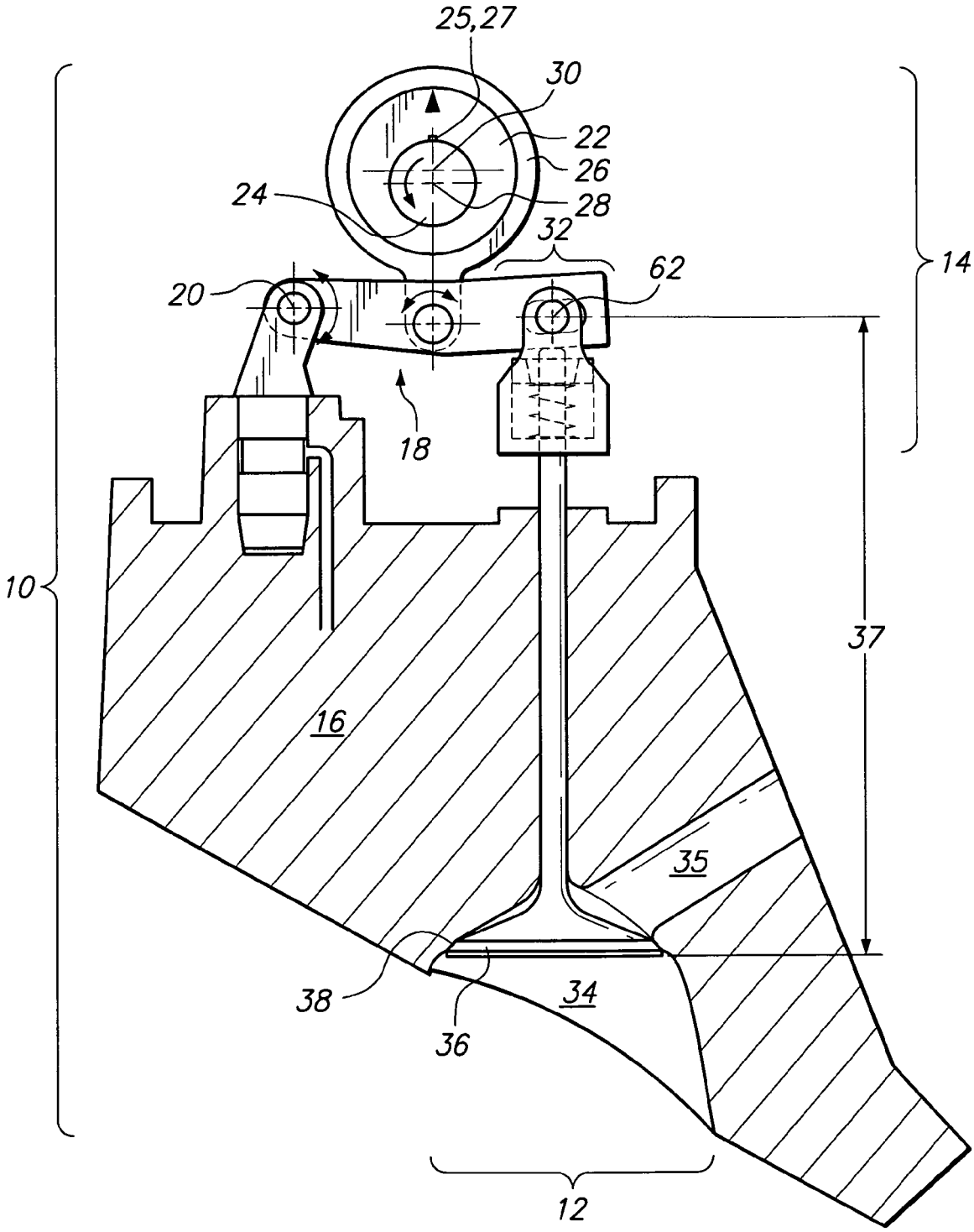
FIG. 1A is a cross sectional view of a first embodiment of an engine illustrating a first angular position of a circular cam lobe.

FIG. 1A illustrates a side cross-sectional view of a head of a conventional engine block 16 with the desmodromic valve and cam system 14 installed thereon. The valve 12 shown in FIG. 1A may be an intake valve or an exhaust valve. For the purposes of simplicity or clarity, only one of the intake and exhaust valves is illustrated herein. However, the desmodromic valve and cam system 14 may be designed into or retrofitted onto one or more of the intake or exhaust valves of the valve train. The desmodromic valve and cam system 14 may comprise a rocker 18 pivotable about a rocker pivot axis 20. The rocker 18 pivots about the rocker pivot axis 20 in response to rotation of a cam lobe 22. In particular, the cam lobe 22 is fixedly mounted to a cam shaft 24. For example, the cam shaft 24 and the cam lobe 22 may have a keyway 25 and be attached to each other with a key 27 such that the cam lobe 22 does not slip about the cam shaft 24 during rotation of the cam shaft 24.

The cam lobe 22 may be received into a follower 26. As shown in FIGS. 1A-D, the cam lobe 22 rotates within the follower 26. The cam lobe 22 is circular and has a rotating axis 28 which is offset from its center 30 but aligned to the center of the camshaft 24. As the cam lobe 22 rotates, the cam lobe 22 lifts up and pushes down the rocker 18 in a cyclical manner. The rocker 18 having a valve portion 32 attached to the valve 12 reciprocates the valve 12 between an open phase and a closed phase. The open phase of the valve 12 is defined by the opening of the valve 12 as the cam lobe 22 rotates. Similarly, the closed phase of the valve 12 is defined by the closing of the valve 12 as the cam lobe 22 rotates.

Figure 1B:
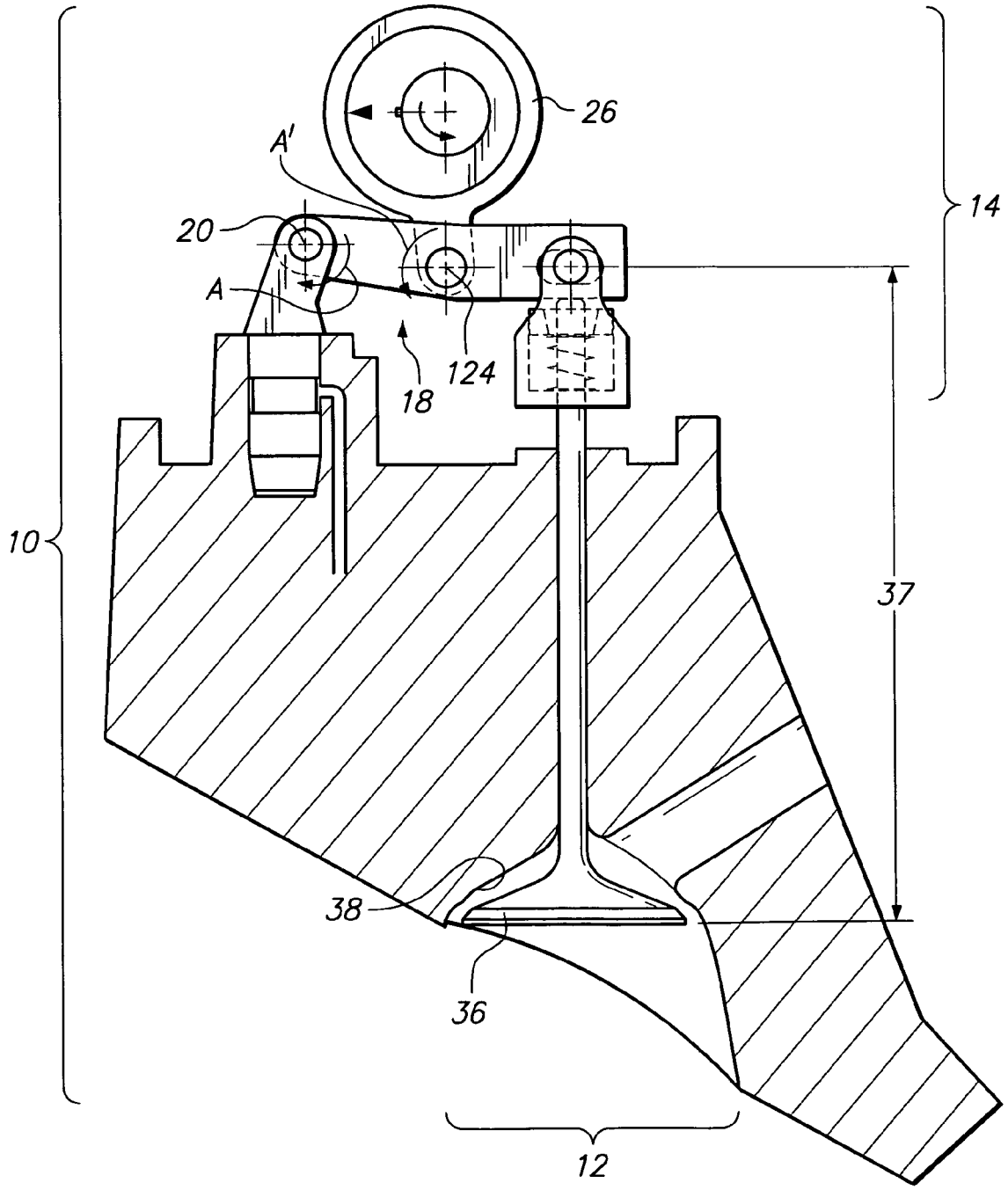
FIG. 1B is a cross sectional view of the engine shown in FIG. 1A illustrating a second angular position of the circular cam lobe.
Figure 1C:
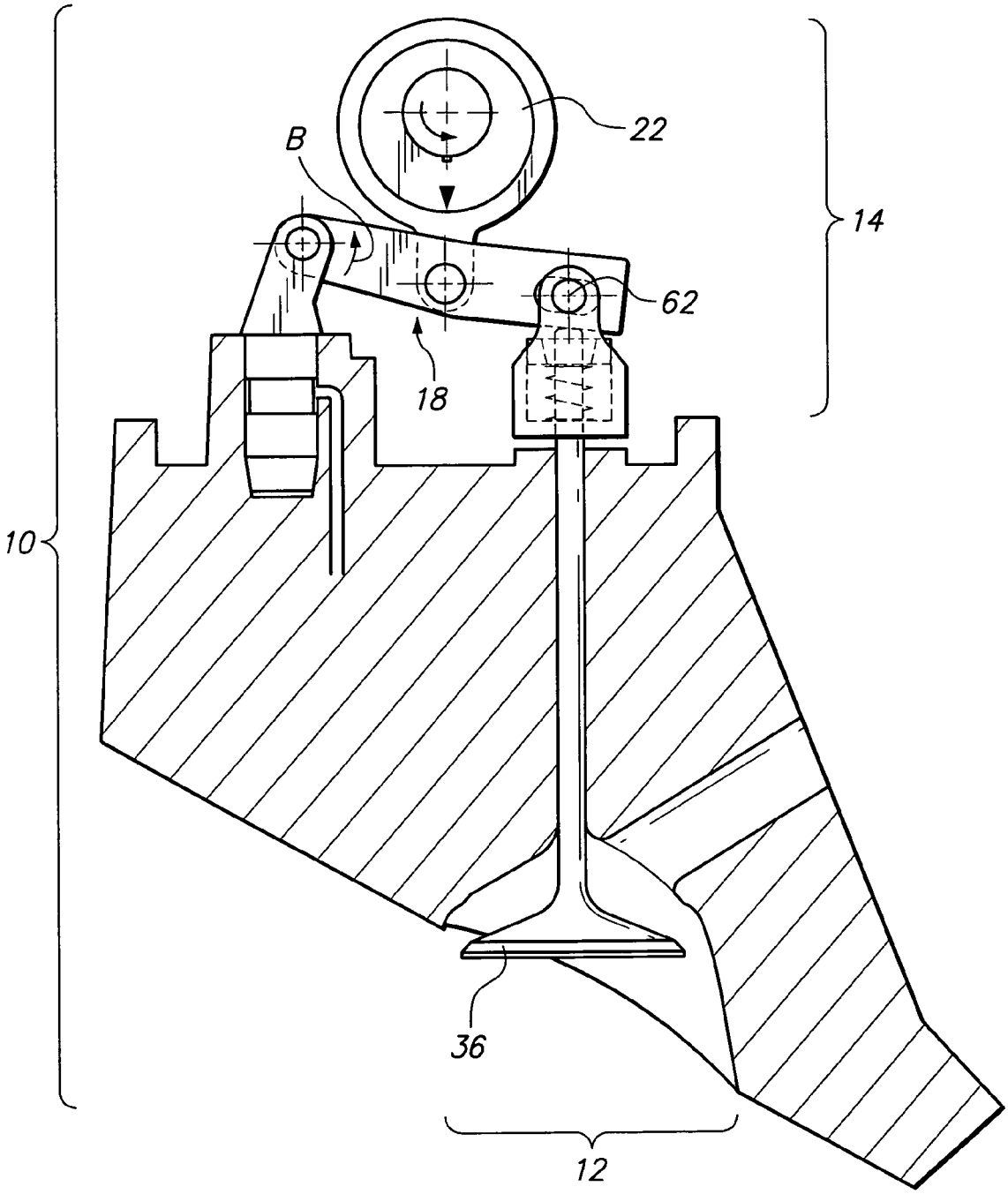
FIG. 1C is a cross sectional view of the engine shown in FIG. 1A illustrating a third angular position of the circular cam lobe.
Figure 1D:
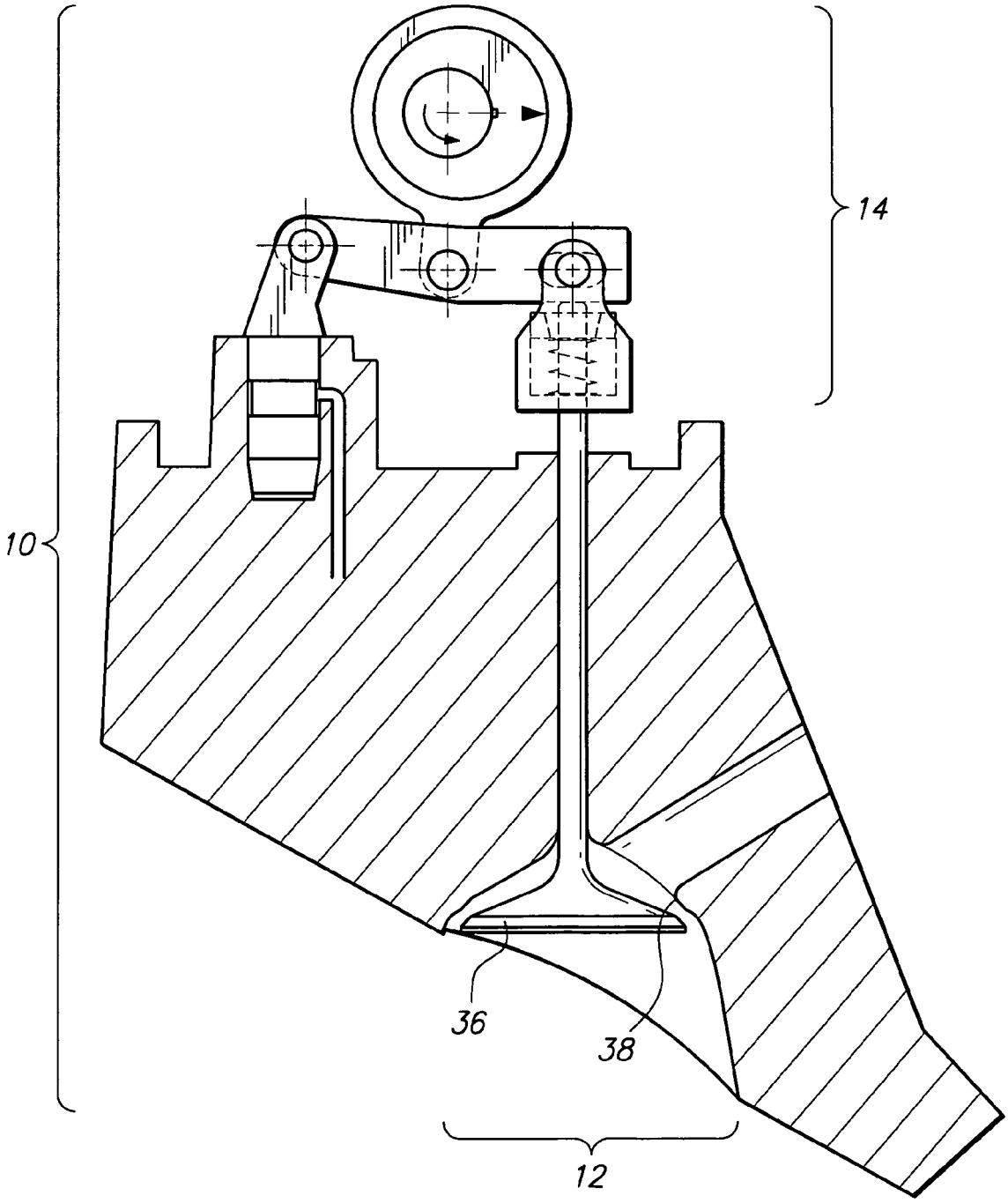
FIG. 1D is a cross sectional view of the engine shown in FIG. 1A illustrating a fourth angular position of the circular cam lobe.

The cam lobe 22 shown in FIG. 1A is positioned at top dead center. At this position, the valve 12 is closed. Gas cannot enter or leave the cylinder 34 via an inlet/outlet 35. As the cam lobe 22 rotates in the counter clockwise direction, the rocker 18 is pivoted about the rocker pivot axis 20 in a downward or clockwise direction (shown by arrow A in FIG. 1B). Also, the follower 26 rotates in the counter clockwise direction about a follower pivot axis 124, as shown by arrow A prime in FIG. 1B. Simultaneously, the valve 12 being normally biased to a retracted position is also traversed toward the retracted position to keep the valve closed. A distance 37 between the valve head and the valve pivot axis 62 is reduced. Once the valve reaches the retracted position, the rocker 18 continues to pivot about the rocker pivot axis 20 and pushes the valve 12 open, as shown in FIG. 1B. At the moment the valve 12 is opened, the valve 12 enters the open phase. When the valve 12 is in the open phase, the valve 12 remains in the retracted position. The cam lobe 22 continues to rotate. At the bottom dead center position of the cam lobe 22 shown in FIG. 1C, the valve 12 is fully opened. As the cam lobe 22 continues to rotate, the rocker 18 pivots in the counter clockwise direction (shown by arrow B in FIG. 1C) thereby closing the valve 12. At some point during the rotation of the cam lobe 22, the valve head 36 contacts the seat of the valve 12. The valve is now closed and remains closed during the closed phase. As the cam lobe 22 continues to rotate toward the top dead center position (see FIG. 1A), the valve 12 is extended toward the extended position (see FIG. 1A). The distance 37 increases until the cam lobe 22 reaches top dead center. At top dead center, the above cycle is repeated.

As can be seen above, the desmodromic valve and cam system 14 does not incorporate a spring that closes the valve 12. Rather, the cam lobe 22 imparts a controlled movement upon the follower 26 and the rocker 18 to open and close the valve 12. The spring described below and used in the desmodromic valve and cam system 14 is used to allow the cam lobe 22 to rotate while the valve 12 remains closed for a period of time. A spring does not push the valve 12 closed when the valve 12 is open.

The valve 12 may be attached to the rocker 18 at the valve portion 32, as shown in FIG. 2. For example, the valve 12 may be pinned to the valve portion 32 of the rocker 18 with a pin 41. More particularly, the valve 12 may comprise a valve stem keeper 40. A body 39 of the valve stem keeper 40 may have a generally cylindrical configuration with a hollowed out center 43. A bottom end portion of the body 39 of the valve stem keeper 40 may have a ledge 42 with an aperture 45 sized and configured to receive a valve stem 44. The valve stem keeper 40 may have a spring 48 disposed within the hollowed out center 43 of the body 39 which biases the valve 12 to the retracted position. The valve stem keeper 40 may additionally have a washer 46 wherein the ledge 42 of the valve stem keeper 40 and the washer 46 sandwiches the spring 48. The washer 46 may have a flattened bottom sized and configured to press against the spring 48. Additionally, the washer 46 may have an inverted frusto conical surface 52. First and second halves of a retaining 54*a, b* may be disposed or secured to an upper distal end portion 56 of the valve stem 44. In particular, the upper distal end portion 56 of the valve stem 44 may have a groove 58. The inner surface of the first and second retaining clips 54*a, b* may have a corresponding ridge 60. The valve stem 44 is initially inserted through the aperture 45 of the body 39, the spring 48 and the washer 46. The first and second retaining clips 54*a, b* are disposed about the upper distal end portion 56 of the valve stem 44 with the ridge 60 of the first and second retaining clips 54*a, b* received into the groove 58 of the upper distal end portion 56 of the valve stem 44. The upper distal end portion 56 and the first and second retaining clips 54*a, b* are lowered until an exterior frusto conical surface 55 of the first and second retaining clips 54*a, b* contacts and mates with the frusto conical surface 52 of the washer 46. The valve stem 44 may be pulled to seat the spring 48 between the washer 46 and the ledge 42. The valve 12 is now biased to the retracted position.

During the reciprocal opening and closing motion of the valve 12, the valve 12 rotates. The valve stem keeper 40 permits the valve 12 to rotate about a longitudinal axis of the valve stem 44. Beneficially, the rotateable aspect of the valve 12 to the rocker 18 prevents stresses imposed upon the valve 12 rotating the valve 12 from overstressing the valve 12.

From the start of the closed phase, the spring 48 begins to compress. During the latter half of the closed phase, the spring decompresses. Also, the valve 12 is traversed from the retracted position to the extended position and back to the retracted position during the closed phase. Beneficially, the valve head 36 remains seated on the valve seat 38 during the closed stage. Conversely, from the start to the end of the open phase of the valve 12, the spring 48 is decompressed and the valve 12 is maintained at the retracted position.

The rocker 18 may be pinned to the valve stem keeper 40 with the pin 41, as shown in FIG. 2. The rocker 18 at the valve portion 32 may have an elongate slot 64. The body 39 of the valve stem keeper 40 may have two tines 66 disposable on opposed sides of the valve portion 32 of the rocker 18. The two tines 66 may additionally have an aperture 65 through which the pin 41 may be inserted. Also, the pin 41 may be inserted through the slot 64 at the valve portion 32. As the rocker 18 pivots about the rocker pivot axis 20, the pin 41 slides back and forth in the slot 64. Additionally, the rocker 18 and the valve stem keeper 40 rotate about each other with respect to the valve pivot axis 70.

The follower 26 may be rotateably attached to the rocker 18. The rocker 18 may have a vertical slot 74 (see FIGS. 2 and 2A) and an aperture 76 formed between side walls 78 of the rocker 18. The follower 26 may have a mounting base 80 (see FIG. 2) sized and configured to be received into the vertical slot 74 (see FIG. 2A). The mounting base 80 may have an aperture 82 alignable to the apertures 76 of the side walls 78 of the rocker 18. A pin 63 may be inserted through the apertures 76 and aperture 82 to rotateably attach the follower 26 to the rocker 18.

The rocker 18 may also define a lifter portion 86. The rocker 18 may be rotateably attached to a lifter 88. In particular, the lifter portion 86 of the rocker 18 may have an aperture 89 sized and configured to receive a pin 90. The lifter 88 may also have two tines 92 sized and configured such that the lifter portion 86 may be disposed between the two tines 92. The two tines 92 may additionally have apertures 91 alignable to the aperture 89 of the lifter portion 86. The pin 90 may be inserted into the aperture 89 of the lifter portion 86 and the apertures 91 of the two tines 92 to rotateably attach the rocker 18 to the lifter 88. The rocker 18 is rotateable with respect to the lifter 88 about the rocker pivot axis 20. The lifter 88 may be held down with a lifter hold down assembly as described in U.S. Pat. App. Ser. No. 60/843,074, filed on Sep. 8, 2006, the entire contents of which are expressly incorporated herein by reference.

The follower 26 may have a circular aperture 96 sized and configured to slidably receive the cam lobe 22. An internal surface 98 of the follower 26 may be defined by the aperture 96. The internal surface 98 may define a camming surface. The cam lobe 22 may have a corresponding circular configuration. The cam lobe 22 may also have an outer surface 100 which slides upon the internal surface 98 of the follower 26. As the cam lobe 22 rotates within the follower 26, the cam lobe 22 imparts cyclical linear movement to the valve 12 such that the valve is reciprocally closed and opened, as discussed above.

Figure 3A:
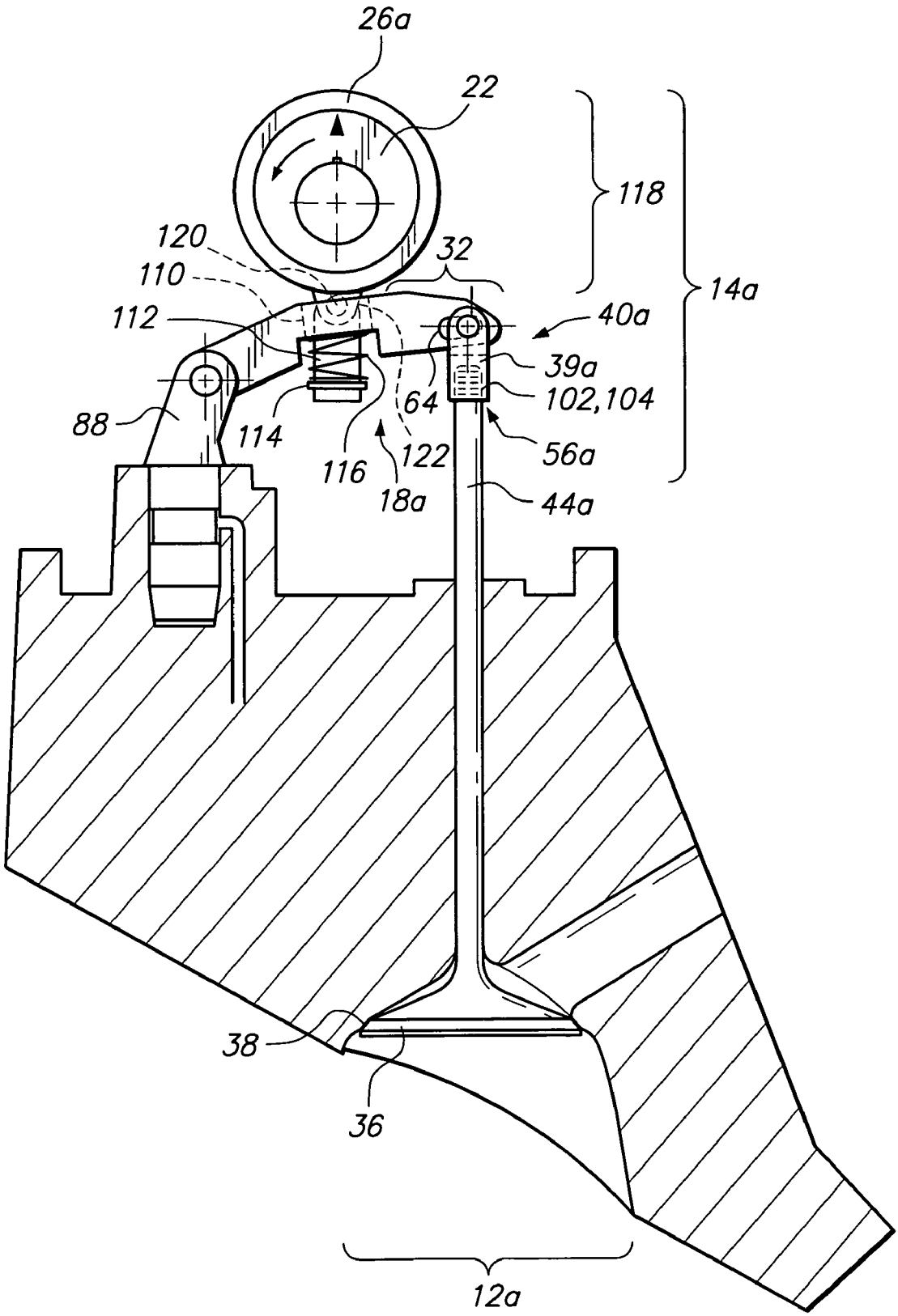
FIG. 3A is a cross sectional view of a second embodiment of an engine illustrating a first angular position of a circular cam lobe.
Figure 3B:
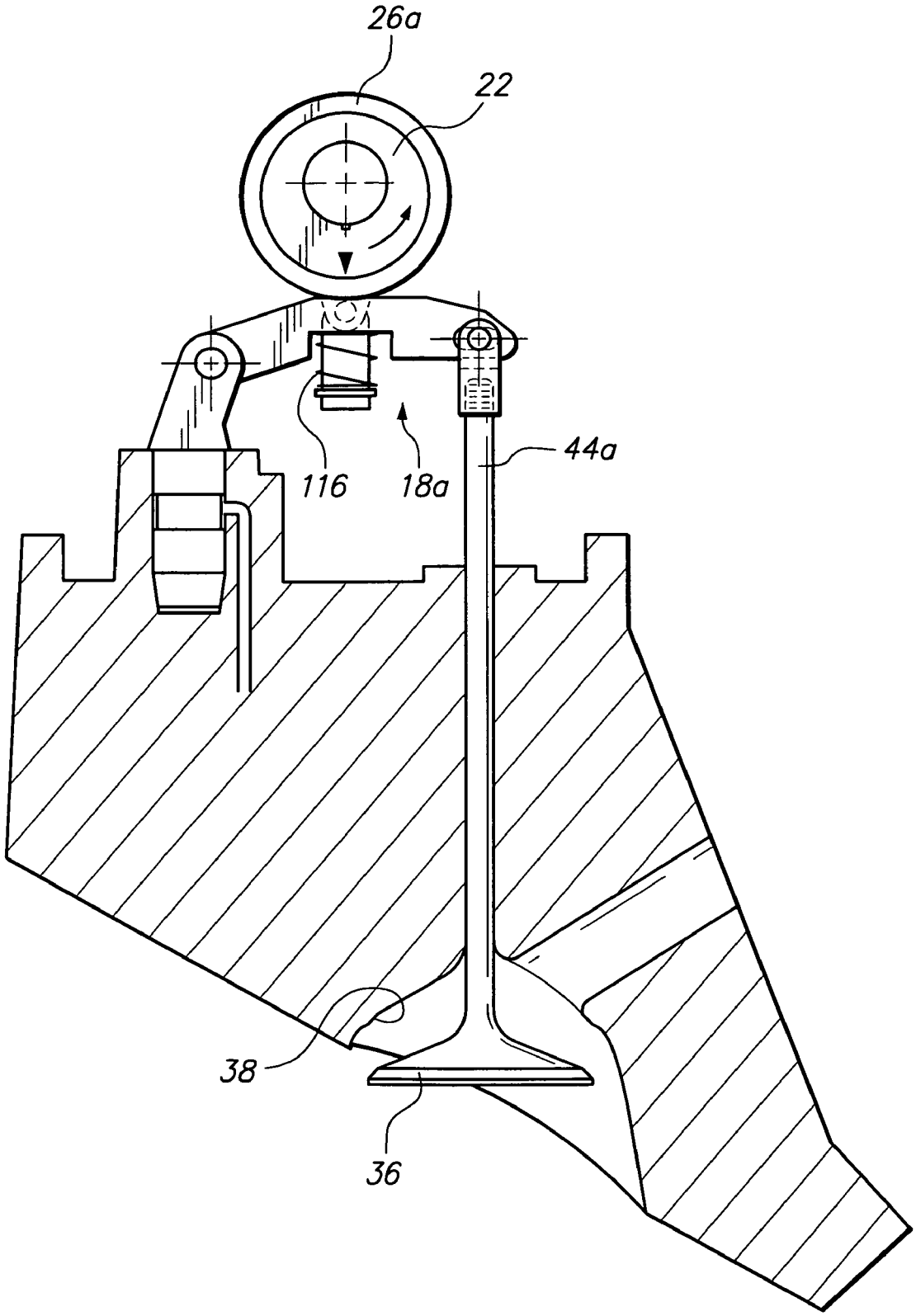
FIG. 3B is a cross sectional view of the engine shown in FIG. 3A illustrating a second angular position of the circular cam lobe.
Figure 4:
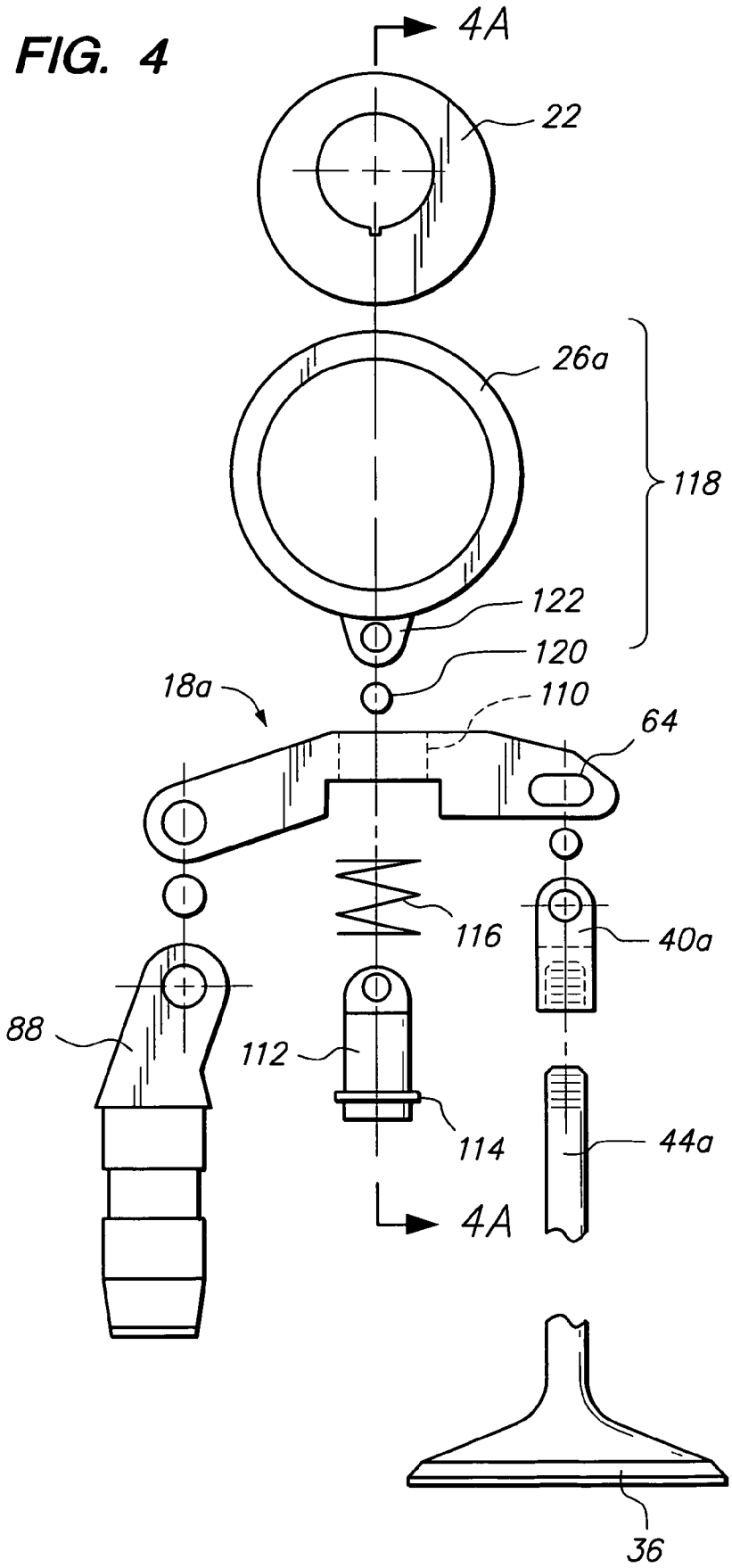
FIG. 4 is an exploded view of the engine shown in FIG. 3A.

Referring now to FIGS. 3A-4, an alternate embodiment of the desmodromic valve and cam system 14*a* is shown. The desmodromic valve and cam system 14*a* may comprise a rocker 18*a*, a follower 26*a*, a lifter 88 and a valve stem keeper 40*a*. Similar to the desmodromic valve and cam system 14 discussed in relation to FIGS. 1A-2, the rocker 18 may have a slot 64 formed in the valve end portion 32 thereof. Optionally, the valve stem keeper 40 may be used to attach the rocker 18*a* to the valve stem 44, as discussed above in relation to FIGS. 1A-2 to allow the valve stem 44 to rotate as the valve 12 reciprocally opens and closes. Alternatively, the valve stem 44*a*, may be fixedly attached to a valve stem keeper 40*a*. By way of example and not limitation, a body 39*a* of the valve stem keeper 40*a* may have a threaded hole 102. The upper distal end portion 56*a* of the valve stem 44*a* may have corresponding threads 104. The threads 104 on the upper distal end portion 56*a* on the valve stem 44*a* may be threaded into the threaded hole 102 of the body 39*a* of the valve stem keeper 40*a*. A locknut (not shown) may be jammed into the bottom end surface of the body 39*a* of the valve stem keeper 40*a* to maintain the position of the valve stem 44*a* to the body 39*a* of the valve stem keeper 40*a*. Alternatively, the valve stem 44*a* may be pinned to the body 39*a* of the valve stem keeper 40*a*. Accordingly, the valve 12*a* is not traversable between a retracted position and an extended position.

The follower 26*a* may be adjustably attached to the rocker 18*a*. More particularly, the rocker 18*a* may have a vertical aperture 110. The follower 26*a* may have a post 112 sized and configured to be slidably received into the vertical aperture 110 of the rocker 18*a*. The post 112 may additionally have a retaining ring 114. The bottom side of the rocker 18*a* may have a cut out sized and configured to receive a spring 116. The spring 116 may be disposed between the rocker 18*a* and the retaining ring 114. As can be seen by comparison of FIGS. 3A and 3B, the follower 26 is traversable between an extended position (see FIG. 3B) and a retracted position (see FIG. 3A). A ring portion 118 of the follower 26 may be rotateably attached to the post 112 with a pin 120. More particularly, the ring portion 118 may have two tines 122 with the post 112 disposable therebetween. Apertures may be formed through the tines 122 and the post 112 which are sized and configured to receive the pin 120.

During operation of the desmodromic valve and cam system 14*a*, the cam lobe 22 may rotate in a counter clockwise direction. At top dead center, the valve head 36 is seated on the valve seat 38 and the follower 26*a* is at the retracted position. As the cam lobe 22 continues to rotate in the counter clockwise direction, the rocker 18*a* begins to pivot downward into the clockwise direction. Simultaneously, the spring decompresses maintaining the valve 12*a* in the closed position. The bottom of the follower 26*a* contacts the top of the rocker 18*a* and pushes the rocker 18*a* down to begin the open phase of the valve 12*a*. The follower 26*a* is at the extended position. Once the follower 26*a* is at the extended position, the bottom of the follower 26*a* contacts the top of the rocker 18*a* and pushes the rocker 18*a* and the valve stem 44*a* down such that the valve 12 is now open. The valve 12*a* is now in the open phase. As the cam lobe 22 continues to rotate in the counter clockwise direction, the bottom of the follower 26*a* pushes the top of the rocker 18*a* until the valve 12*a* is fully open, as shown in FIG. 3A. The follower 26*a* is maintained at the retracted position until the valve enters the closed phase. Once the valve 12*a* is fully open, the cam lobe 22 pulls the follower 26*a* upward as the cam lobe continues to rotate. This transfers an upward force on the bottom of the rocker 18*a* via the spring 116 and begins to close the valve 12*a*. Once the valve head 36 contacts the seat 38, the valve 12*a* is closed and the rocker 18*a* remains stationary. As the cam lobe 22 continues to rotate, the follower 26*a* is traversed upward and the spring 116 is compressed. The cam lobe 22 continues to rotate and cycles the spring between the open and close states respectively shown in FIGS. 3A and B.

Figure 5:
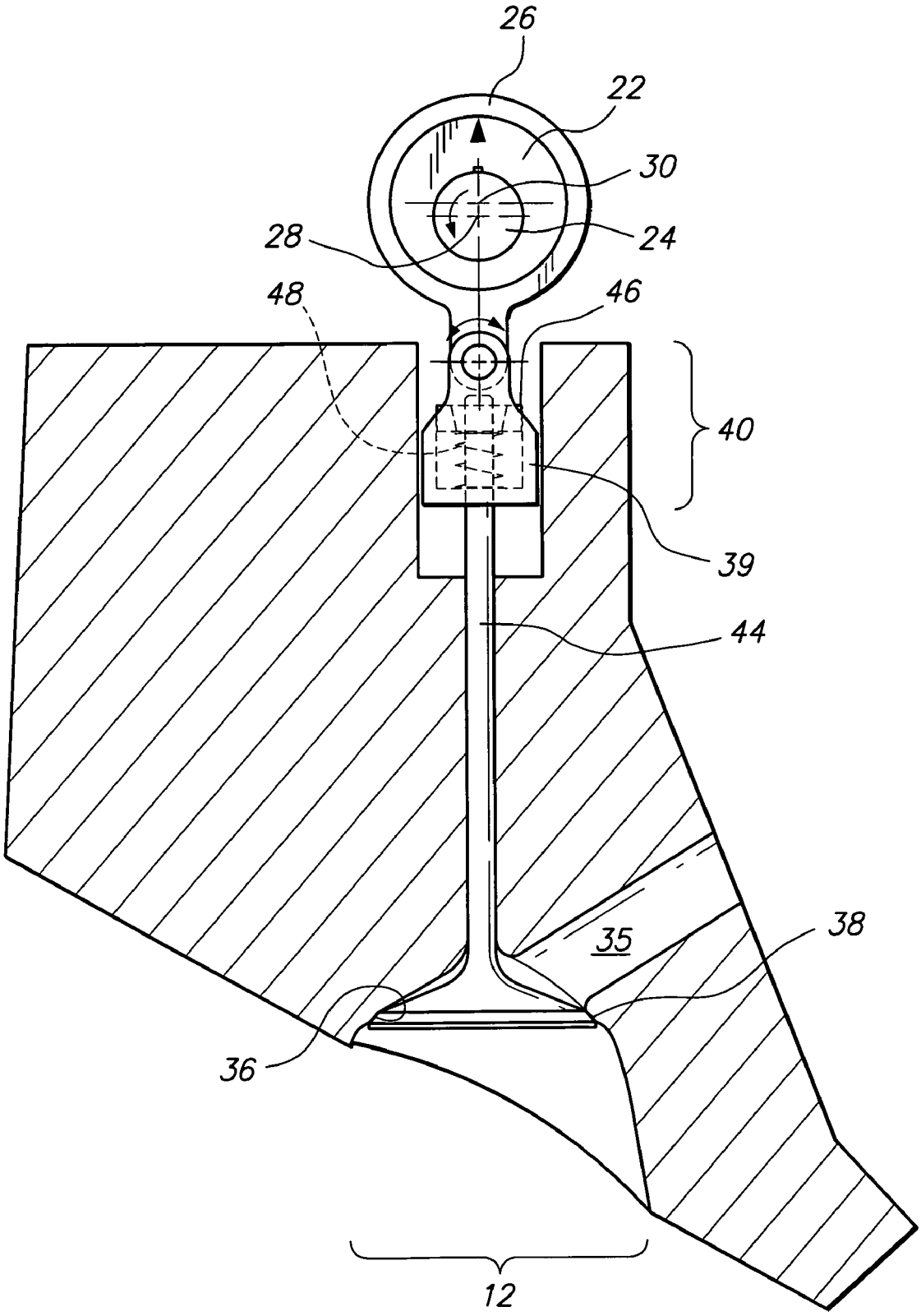
FIG. 5 is a cross sectional view of a third embodiment of an engine wherein a valve is opened and closed with a circular cam lobe.
Figure 5A:
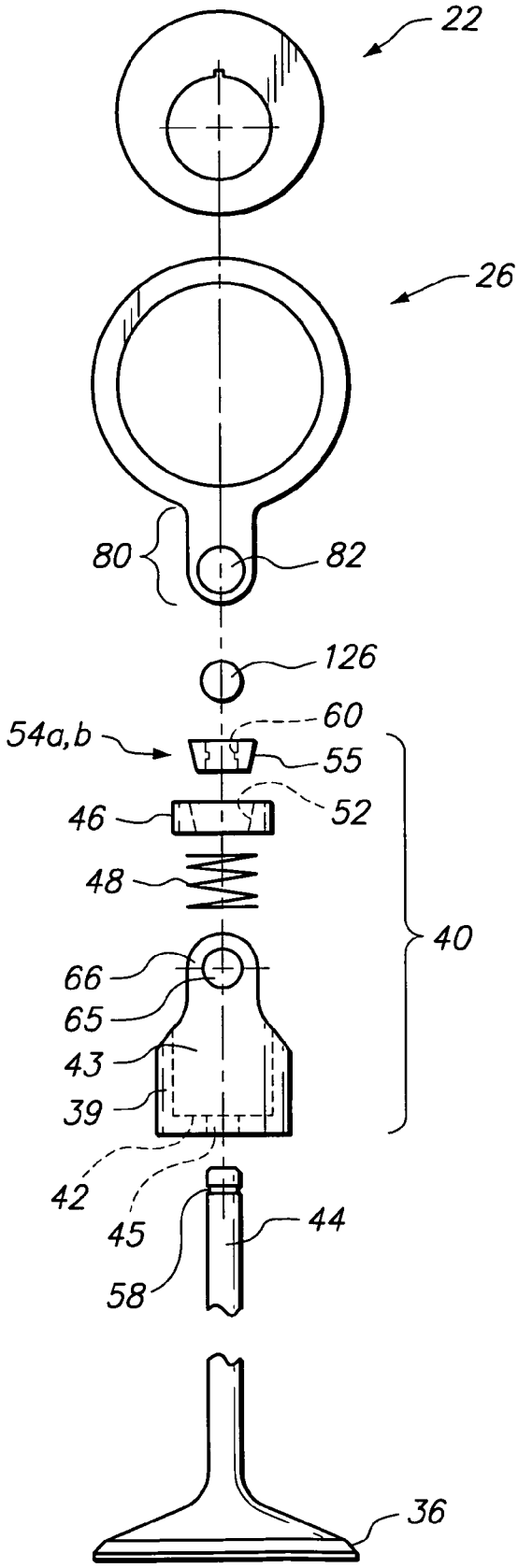
FIG. 5A is an exploded view of the engine shown in FIG. 5.

Referring now to FIG. 5-5A, a rockerless desmodromic valve system is shown. In particular, the desmodromic valve system may comprise the cam lobe 22, the follower 26, the valve stem keeper 40 and the valve 12. The valve stem 44 may be connected to the body 39 of the valve stem keeper 40 in the same manner discussed above in relation to the desmodromic valve system shown in FIG. 2. In particular, the valve stem 44 may be inserted through the aperture 45 of the body 39 of the valve stem keeper 40. The spring 48 may be disposed about the valve stem 44 and within the hollowed out center 43 of the body 39 of the valve stem keeper 40. The washer 46 may sandwich the spring 48 along with the ledge 42 of the valve stem keeper 40. The ridge 60 of the first and second retaining clips 54*a, b* may be disposed within the groove 58 of the upper distal end portion 56 of the valve stem 44. The valve stem 44 may then be pulled downward until the frusto conical surface 55 of the first and second retaining clips 54*a, b* contacts the frusto conical surface 52 of the washer 46. The body 39 of the valve stem keeper 40 may be attached to the mounting base 80 of the follower 26. By way of example and not limitation, the body 39 of the valve stem keeper 40 may be attached to the follower 26 with a pin 126. The pin 126 may be inserted through the aperture 65 of the body 39 of the valve stem keeper 40 as well as the aperture 82 of the mounting base 80 of the follower 26. Other means of attaching the follower 26 to the valve stem keeper 40 are also contemplated. For example, the mounting base 80 may be welded to the tines 66 of the body 39 of the valve stem keeper 40.

During operation, when the cam lobe is at top dead center (see FIG. 5), the valve head 36 is seated on the valve seat 38. The spring 48 is also fully compressed. The cam lobe 22 continues to rotate thereby decompressing the spring 48. As the spring 48 decompresses, the valve head 36 remains seated on the valve seat 38. When the spring 48 is fully decompressed, the follower 26 pushes the valve stem keeper 40 downward and eventually pushes the valve head 36 off of the valve seat 38. At this point, the valve is opened. Gases are allowed to enter or exit the inlet/outlet 35. As the cam lobe 22 continues to rotate, the valve head 36 is lowered then raised back upwards closer to the valve seat 38. When the valve head 36 contacts the valve seat 38, the valve is now closed. The spring 48 begins to compress as the cam lobe 22 continues to rotate toward the topmost position. The spring 48 continues to rotate until the cam lobe 22 reaches the topmost position. At this point, the above cycle is repeated.

In an aspect of the desmodromic valve system of the embodiments discussed herein, it is contemplated that the physical center 30 of the cam lobe 22 be aligned with the rotating center of the cam shaft 24.

In a further aspect of the desmodromic valve system, the various components thereof may be sized and configured such that the valve 12 remains closed during about 180° to 240° of the angular rotation of the cam shaft 24. Conversely, the various components of the desmodromic valve system may be sized and configured to open the valve 12 for about 180° to about 120° of the rotational angle of the cam shaft 24. Preferably, the components of the desmodromic valve system are sized and configured such that the valve remains closed about 220° to 240° of the angular rotation of the cam shaft 24 while the valve remains open during about 120° to 140° of the angular rotation of the cam shaft 24.

Figure 4A:
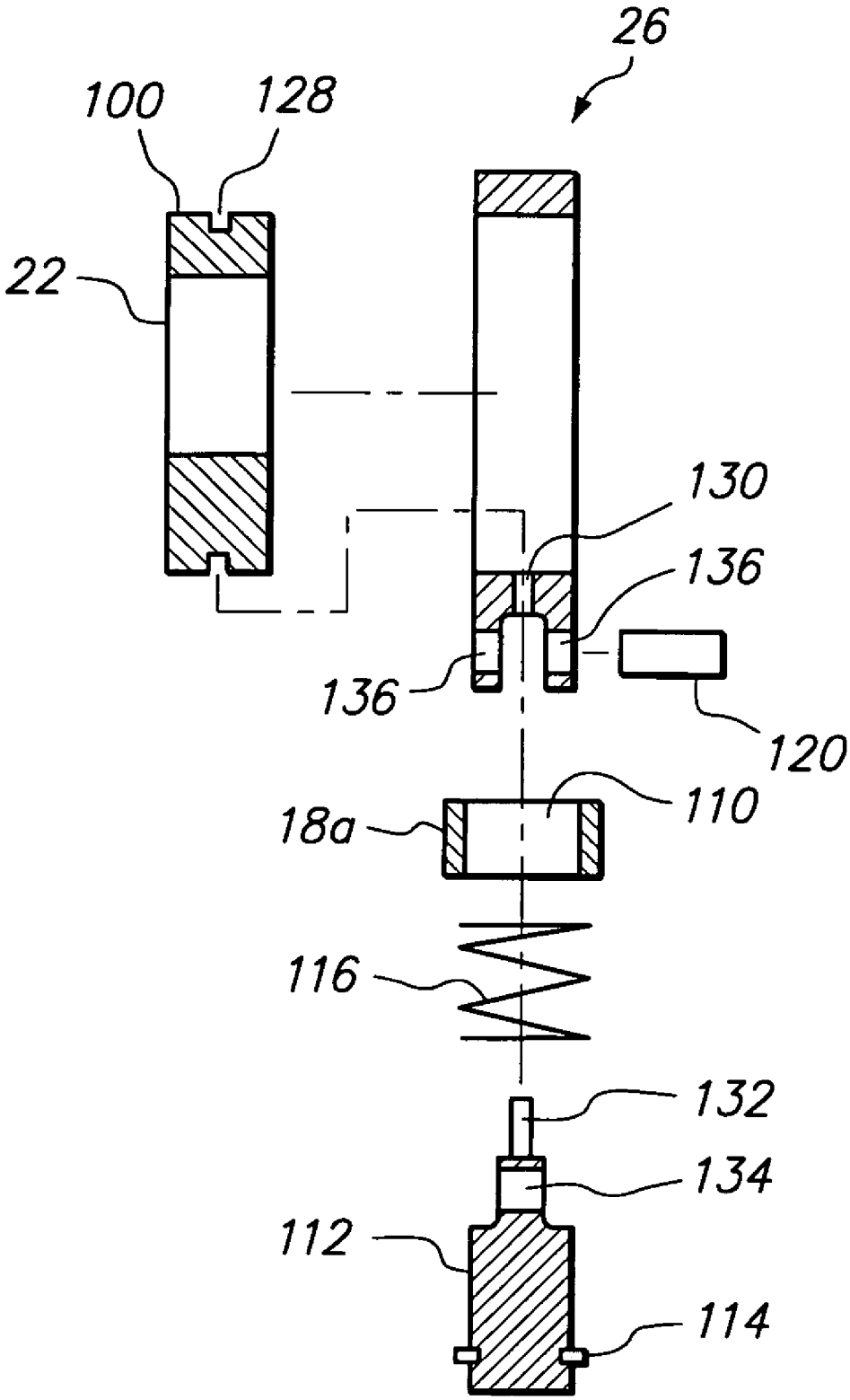
FIG. 4A is an exploded cross sectional view of similar components to the components shown in FIG. 4.

Referring now to FIG. 4A, a cross sectional view of components similar to the components shown in FIG. 4 is shown. The components of those shown in FIG. 4 have been modified to illustrate a tongue and groove configuration to permit the cam lobe 22 to remain centered on the follower 26. In particular, the cam lobe 22 may have a groove 128 formed about its outer surface 100. The groove 128 is preferably centered on the outer surface 100 of the cam lobe 22. An aperture 130 may be formed through the lower portion of the follower 26 the aperture 130 may be aligned to the groove 128. The aperture 130 may also be sized and configured to receive a nub 132 of the post 112. To assemble the system, the spring 116 is disposed about the post 112 and rests on the retaining ring 114. The spring 116 and the post 112 are inserted through the vertical aperture 110 of the rocker 18*a* the post 112 is inserted through the aperture 110 until the aperture 134 of the post 112 is aligned to the apertures 136 of the follower 26. The pin 120 is inserted into the aperture 134 and apertures 136 to secure the follower 26 to the post 112. At this time, the nub 132 of the post 112 protrudes through the aperture 130 of the follower 26 and into the groove 128 of the cam lobe 22. As the cam lobe rotates, the nub 132 rides within the groove 128 to keep the cam lobe 22 centered on the follower 26. It is also contemplated that the other embodiments of the desmodromic valve system may have a groove formed on the outer surface of the cam lobe sized and configured to receive a nub to maintain the position of the cam lobe 22 within the follower 26. Beneficially, the nub and groove configuration permits the desmodromic valve system to operate at high rpms.

In the embodiments discussed above, the spring 48, 116 must be strong enough such that the spring 48, 116 only negligibly compresses when the cam lobe rotates to close the valve due to the mass of the valve head and other components.

The spring 48, 116 discussed above permits the valve 12 to remain closed for a set period of time to allow the cylinder to go through its various stages as discussed in the background. By way of example and not limitation, the spring 48, 116 permits the valve 12 to remain closed for at least ten percent of the angular rotation of the cam lobe.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. An engine having a rotating shaft, the engine comprising:

a circular cam lobe attachable to the rotating shaft;

a follower having a circular aperture sized and configured to slidably receive the cam lobe;

a rocker defining a first portion and a second portion, the follower being attached to the rocker between the first and second portions of the rocker;

a valve having a valve stem attached to the first portion of the rocker;

a lifter attached to the second portion of the rocker;

a spring interconnected between the follower and the valve to allow the valve to remain closed longer than the valve remains open.

2. The engine of claim 1 wherein the valve stem is extendable from the rocker to an extended position from a retracted position for maintaining the valve in the closed position.

3. The engine of claim 2 wherein valve stem is retractable from the extended position to the retracted position with the spring.

4. The engine of claim 1 wherein the follower is extendable from the rocker to an extended position from a retracted position for maintaining the valve in the closed position.

5. The engine of claim 4 wherein the follower is retractable from the extended position to the retracted position with a spring.

6. The engine of claim 1 wherein a physical center of the cam lobe is offset from a rotating axis of the shaft.

7. The engine of claim 1 wherein a groove is formed in an outer surface of the cam lobe and a nub is inserted into the groove to maintain the cam lob within the follower as the cam lobe rotates.

8. An engine having a rotating shaft, the engine comprising:

a circular cam lobe attachable to the rotating shaft;

a follower having a circular aperture sized and configured to slidably receive the cam lobe;

a valve having a valve stem attached to the follower;

a spring interconnected between the follower and the valve to allow the valve to remain closed longer than the valve remains open.

9. The engine of claim 8 wherein a physical center of the cam lobe is offset from a rotating axis of the shaft.

10. The engine of claim 8 comprising a valve stem keeper attached to the valve stem of the valve and a mounting base of the follower.

11. The engine of claim 10 wherein the valve stem is spring loaded to the valve stem keeper with the spring.

12. The engine of claim 8 wherein the cam lobe defines an outer surface, and the outer surface has a groove about an entire circumference of the cam lobe.

13. The engine of claim 12 further comprising a nub protruding from an inner surface of the follower and sized and configured to be received into the groove of the cam lobe.

14. An engine having a rotating shaft, the engine comprising:

a circular cam lobe attachable to the rotating shaft;

a valve traverseable between an open position and a closed position, the valve connected to the circular cam lobe such that the circular cam lobe opens and closes the valve as the circular cam lobe rotates;

a spring interposed between the circular cam lobe and the valve to allow the valve to remain closed longer than the valve remains open.

15. An engine having a rotating shaft, the engine comprising:

a circular cam lobe attachable to the rotating shaft;

a valve traverseable between an open position and a closed position, the valve connected to the circular cam lobe such that the circular cam lobe opens and closes the valve as the circular cam lobe rotates;

a spring interposed between the circular cam lobe and the valve to allow the valve to remain closed for at least 180° of the angular rotation of rotating shaft.

* * * * *